United States Patent [19]

Hand et al.

[11] Patent Number: 4,635,563

[45] Date of Patent: Jan. 13, 1987

[54] ADJUSTABLE SHELVING SYSTEM

[75] Inventors: George E. Hand, Excelsior; Roman A. Kramer, Bloomington, both of Minn.

[73] Assignee: Interplastic Corporation, Minneapolis, Minn.

[21] Appl. No.: 650,789

[22] Filed: Sep. 17, 1984

[51] Int. Cl.[4] ..... A47B 9/00

[52] U.S. Cl. ..... 108/111; 108/144

[58] Field of Search ..... 108/111, 110, 144, 64, 108/114; 211/153

[56] References Cited

U.S. PATENT DOCUMENTS

| | | | |
|---|---|---|---|
| 3,424,111 | 1/1969 | Maslow | 108/144 |
| 3,757,705 | 9/1973 | Maslow | 108/144 |
| 4,128,064 | 12/1978 | Chung et al. | 108/111 |
| 4,272,136 | 6/1981 | Sengua | 248/188.4 X |
| 4,318,352 | 3/1982 | Friedman et al. | 108/111 |
| 4,397,247 | 8/1983 | Lemelson | 108/51.1 X |
| 4,428,306 | 1/1984 | Dresen et al. | 108/901 X |
| 4,435,463 | 3/1984 | Roellchen | 108/901 X |
| 4,474,491 | 10/1984 | Ferrarelli | 108/111 |

FOREIGN PATENT DOCUMENTS

| | | |
|---|---|---|
| 624244 | 2/1963 | Belgium . |
| 2059815 | 4/1971 | France . |
| 2526648 | 5/1982 | France . |

*Primary Examiner*—Kenneth J. Dorner
*Assistant Examiner*—José V. Chen
*Attorney, Agent, or Firm*—Kinney & Lange

[57] ABSTRACT

The present invention is a shelving system having height adjustable shelves. The shelving system includes a plurality of elongated support posts having recesses spaced along the longitudinal axis. At least one resilient support post clip is attached to each support post within a recess to provide a shelf support. A shelf member having recesses at least partially accepting the post clip, is positioned in detachable nesting relationship with the support clips.

The shelf member further includes an upper surface having alternating transverse ribs and recesses, and a lower surface having alternating longitudinal ribs and recesses. The ribs serve to reinforce the shelf member both longitudinally and transversely.

Each shelf member further comprises an outward projecting support rail extending along one or more edges of each shelf member. A connecting mechanism simultaneously engages the support rails of adjacent shelf members and retains the adjacent shelf members in fixed relation with each other.

14 Claims, 10 Drawing Figures

ADJUSTABLE SHELVING SYSTEM

BACKGROUND OF THE INVENTION

1. Field of the Invention

The present invention relates generally to readily assembled molded shelving with height adjustable shelves.

2. Description of the Prior Art

Several types of adjustable shelving systems have been employed in the prior art. One type of system has corner posts provided with recesses around their exterior with adjustable, multi-part shelf supports fastened around each support post within a recess. An embodiment of such a support has two pieces which form a frusto-conical shaped exterior and a projecting rib member on the interior wall. The shelf supports are fastened to the corner posts with the rib engaging a corner post recess to retain the shelf support in place on the corner post. The shelf support frusto-conical exterior is mated with a frusto-conical recess in a shelf member such that the shelf member is wedged over the shelf support in fixed relationship with the corner post. Representative of this type of shelving systems are U.S. Pat. No. 3,424,111 to Maslow, U.S. Pat. No. 4,318,352 to Friedman, et al., U.S. Pat. No. 3,757,705 to Maslow, U.S. Pat. No. 3,523,508 to Maslow, U.S. Pat. No. 3,874,511 to Maslow and U.S. Pat. No. 3,927,769 to Maslow, et al. One disadvantage of the shelving systems discussed above is the number of parts. As a result, a significant amount of time is spent in disassembling and reassembling when the height of the shelf is adjusted.

In addition to the above shelf support systems, several prior art patents describe the use of spaced elongated extrusions or ribs on one surface of a shelf member which are intended to reduce or eliminate bowing of the shelf member. One such system disclosing unitary spaced ribs on one surface of the shelf member is shown in U.S. Pat. No. 3,323,656 to Weiss et al. A similar pallet assembly is disclosed in U.S. Pat. No. 3,719,157 to Arcocha et al. However, in both cases, little reinforcement is provided to the shelf member transverse to the longitudinal axis of the ribs. Other approaches form grid structures of longitudinal and transverse ribs on one surface of a shelf or pallet. Representative of these types of pallets or shelves are U.S. Pat. No. 3,680,495 to Pike, U.S. Pat. No. 3,228,358 to Sepe et al., and U.S. Pat. No. 3,917,108 to Thurmen.

SUMMARY OF THE INVENTION

The present invention includes apparatus for quickly assembling shelving with height adjustable shelves. The shelving apparatus includes a plurality of elongated support posts having recesses spaced along the longitudinal axis. For each support post there is at least one resilient support post clip detachably fastened around the support post within a recess to provide an adjustable shelf support. The shelving apparatus further comprises at least one elongated shelf member in detachable nesting relationship with the support post clips. The shelf member includes a recess at least partially accepting a post clip fastened around a support post. Upon mating of the support post clips and shelf member recesses, the shelf member and support post are retained in a fixed relationship until the shelf member is removed.

Upon removal of the shelf member from the shelving apparatus, the support post clips are again exposed. The shelf height may then be adjusted by detaching the clips from the posts and reattaching the clips within a support post recess above or below the original position, and then repositioning the shelf member in nesting relationship with the support clip.

In a preferred embodiment of the shelving apparatus of the present invention, each shelf member further comprises an outward projecting support rail extending along one or more edges of each shelf member. A connecting mechanism simultaneously engages the support rails of adjacent shelf members and retains the adjacent shelf members in fixed relationship with each other.

Also in a preferred embodiment, the shelf member has ribbed upper and lower surfaces. The upper surface is defined by transverse ribs projecting upward. The lower surface is defined by longitudinal ribs projecting downward. Recesses between the ribs of one surface join with the recesses between ribs of the other surface at their intersection. The ribs and recesses of both the upper and lower surface provide additional strength to the shelf member.

Further objects and advantages of the adjustable shelving of the present invention will become apparent from the drawings and the description of the preferred embodiment.

DETAILED DESCRIPTION OF THE PREFERRED EMBODIMENTS

Figure 1:
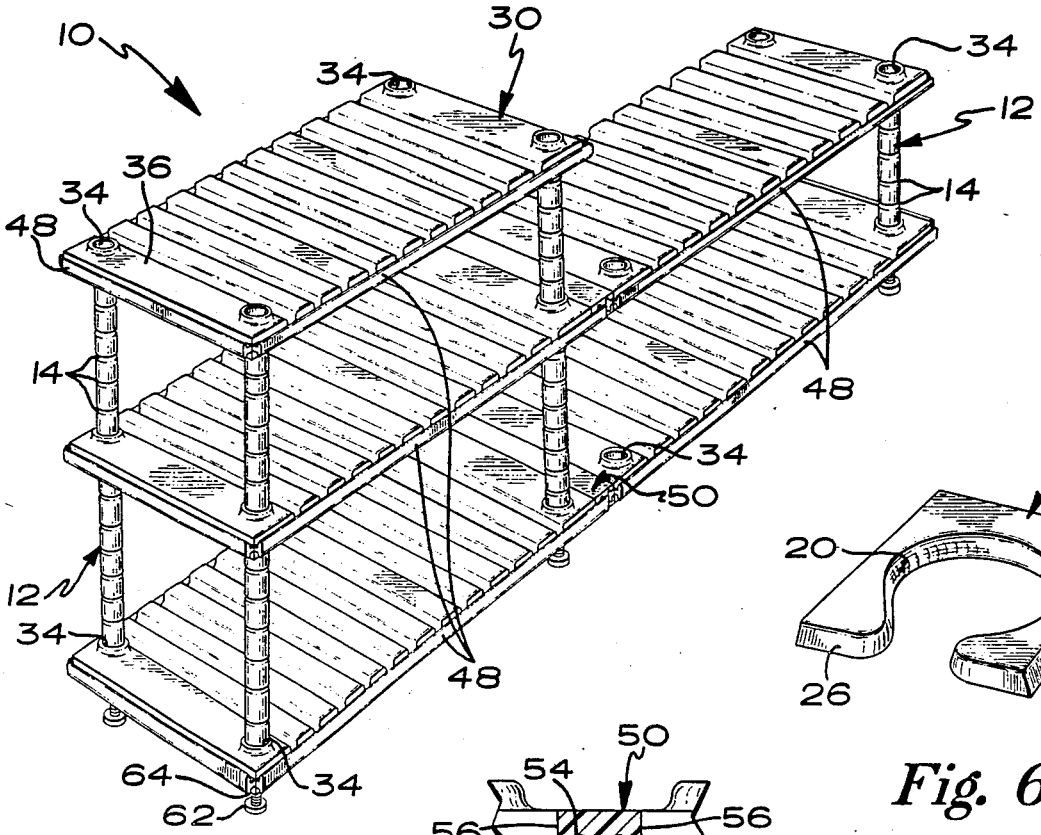
FIG. 1 is a perspective view of a preferred embodiment of the adjustable shelving apparatus of the present invention.

A preferred embodiment of the shelving system of the present invention is generally indicated at 10 in FIG. 1. The shelving system 10 comprises a plurality of elongated support posts 12 having a plurality of recesses 14, spaced at predetermined intervals along the support post 12 longitudinal axis. As shown, support posts 12 are preferably cylindrical with annular recesses, although other configurations are possible.

Figure 6:
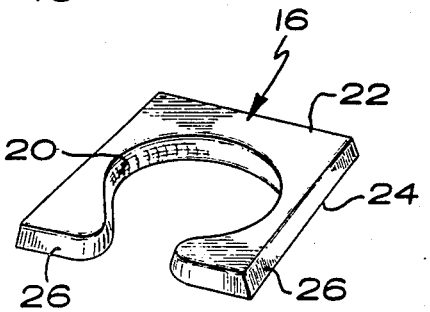
FIG. 6 is a perspective view of a first preferred embodiment of a support post clip.
Figure 8:
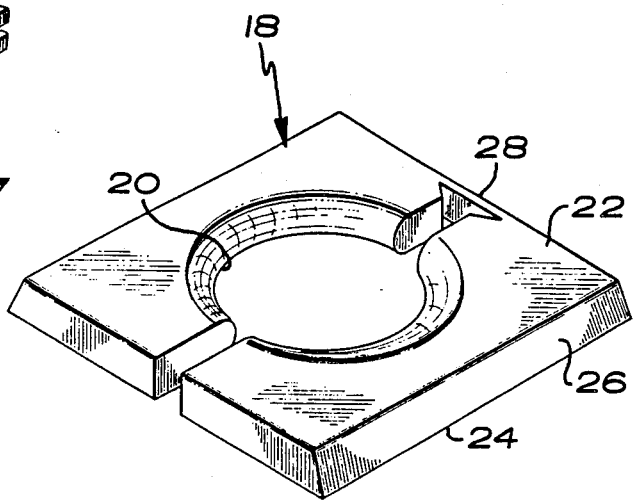
FIG. 8 is a perspective view of a second preferred embodiment of a support post clip.
Figure 9:
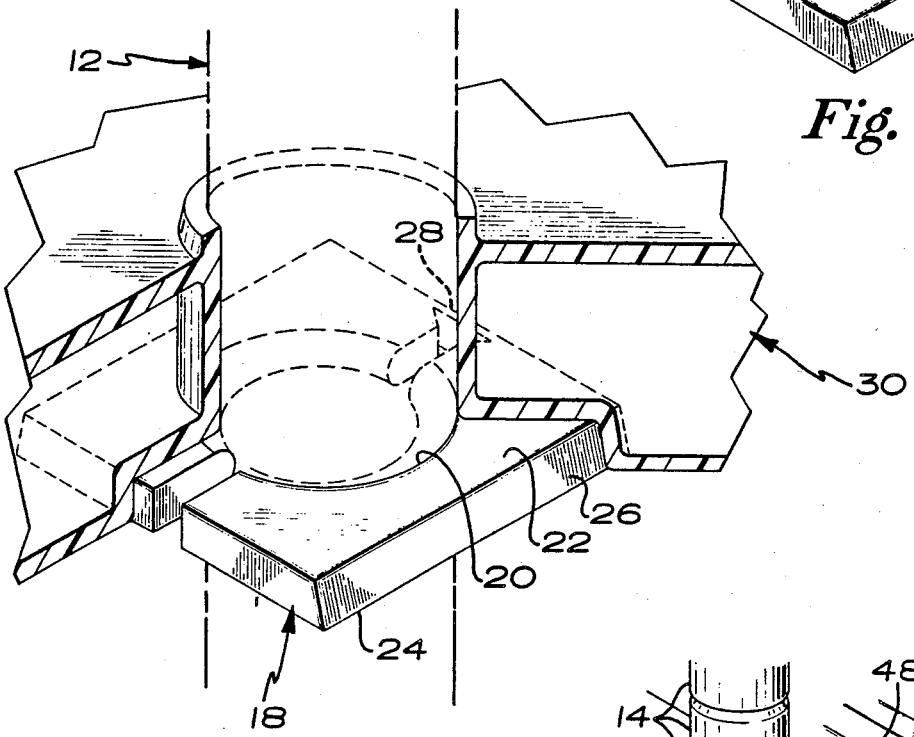
FIG. 9 is an enlarged fragmented view showing a shelf member in nesting relationship with a support clip, with sections of the shelf member broken away.
Figure 10:
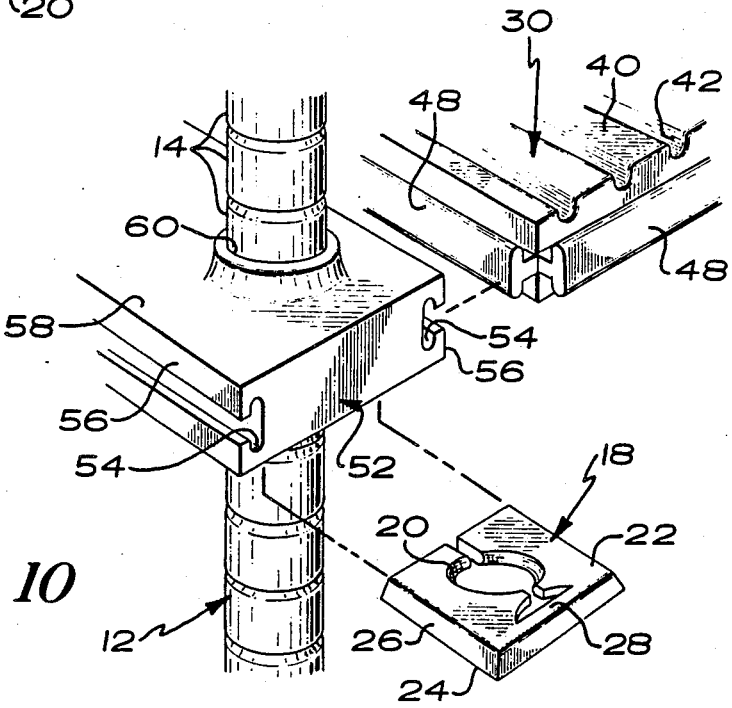
FIG. 10 is an exploded view of the second embodiment of the connecting mechanism in nesting relationship with a support post clip and support post, and showing the alignment of the connecting mechanism with a shelf member.

The shelving system 10 further comprises at least one resilient support post clip, such as clip 16 shown in FIG. 6 or clip 18 shown in FIG. 8, for each support post 12. The support post clips are arranged to be detachably fastened around each support post 12 within a recess 14 for providing an adjustable shelf support in a manner described below.

As shown in FIGS. 6 and 8, the preferred resilient support post clips 16 and 18, respectively, define a central opening 20 of configuration to mate in lateral cross section with the support post recesses 14. Clips 16 and 18 further have slightly tapered edges 26 extending between an upper surface 22 and a lower surface 24 to form a truncated pyramid. The overall resiliency of the clips 16 and 18 allow them to be positioned within a recess 14 to engage that recess.

Clip 18 is an enhanced version of clip 16. Whereas clip 16 is formed of generally resilient material, clip 18 may be formed of rigid or resilient material, as long as clip 18 includes a resilient hinge member, such as the flexible strip 28 shown in FIG. 8.

Figure 2:
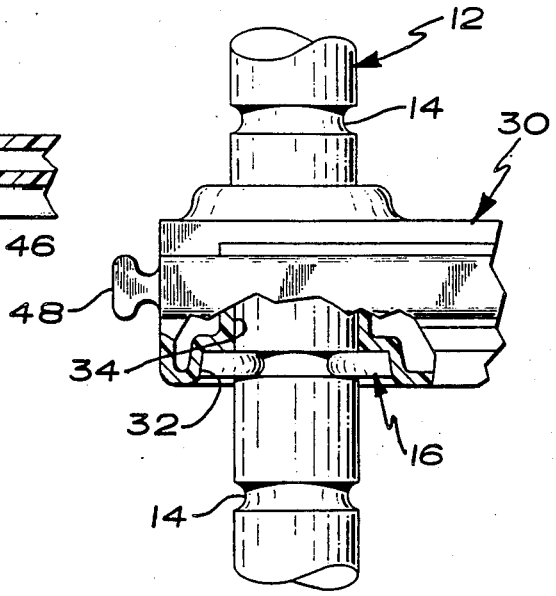
FIG. 2 is a fragmented front plan view showing a shelf member in nesting relationship with a support clip, with sections of the shelf member broken away.

Shelving system 10 further comprises at least one and preferably a plurality of elongated shelf members 30, as shown in FIG. 1. Shelf members 30 include recesses 32 preferably at the corners as shown in FIG. 2, at least partially accepting and detachably nesting with a support post clip attached around a support post 12 within a recess 14. Recesses 32 are preferably of size and configuration to mate with a support post clip and particularly, to engage the tapered edges 26. An aperture 34, coincident with each recess 32, receives one of the support posts 12 therethrough. Thus, shelf member 30 may be mated with support posts 12 such that support posts 12 extend through apertures 34. Upon engagement between recesses 32 and a support post clip, shelf member 30 will be effectively retained in fixed relation with support posts 12. The nesting relationship between the recesses 32 and the support post clips will also prevent the support post clips from being withdrawn from the support post recesses 14 until and unless shelf member 30 is first removed.

It is also preferred that shelf member 30 comprise an upper surface 36 with alternating ribs and recesses, and a lower surface 38 also having alternating ribs and recesses. The upper surface 36 preferably has transverse support ribs 40 projecting upward while lower surface 38 has longitudinal support ribs 44 projecting downward. It is preferred that the upper surface ribs 40 be substantially wider than recesses 42 therebetween, to provide a stable platform for items positioned thereon. It is also preferred that the lower surface ribs 44 be substantially wider than recesses 46 therebetween. Recesses 42 between the upper surface ribs 40 are preferably orthogonal to recesses 46 between lower surface ribs 44. It is also preferred that recesses 42 and 46 join or "kiss" at their intersection, which significantly enhances the weight bearing strength of the shelf members 30. That is, the upper surface recesses 42 and lower surface recesses 46 are at least bonded, if not unitary, at their intersection.

Figure 4:
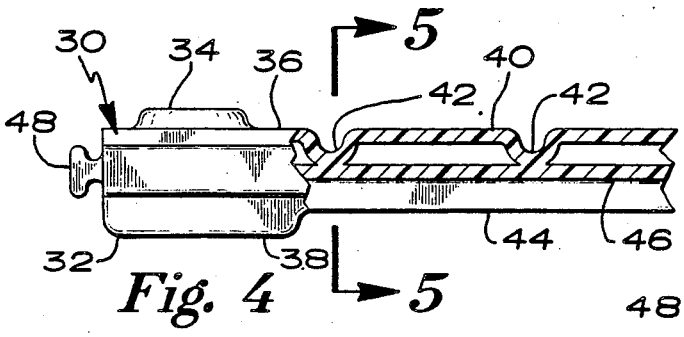
FIG. 4 is a fragmented front plan view of a portion of a shelf member with sections broken away disclosing the upper surface ribs and the lower surface ribs.
Figure 5:
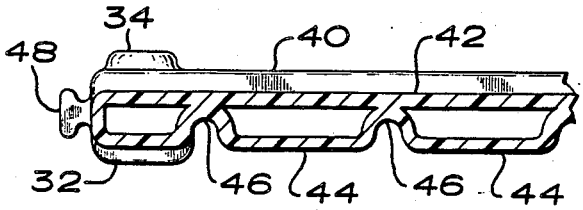
FIG. 5 is a cross sectional view of the shelf member taken along the line 5—5 of FIG. 4, showing the upper surface ribs and the lower surface ribs.

Although it is preferred that the ribs 40 of upper surface 36 and ribs 44 of lower surface 38 have a substantially rectangular cross section to provide a generally flat upper and lower surface, ribs of different cross section may be utilized. Also, because of the strength provided by the upper surface ribs 40 and lower surface ribs 44, and the joining of the intermediate recesses 42 and 46 respectively, the shelf member 30 may be molded plastic and have hollow ribs, as shown in FIGS. 4 and 5.

The rib arrangement of the shelf members 30 of the present invention are further advantageous in that they allow air to be circulated through the recesses 42 and 46 between ribs on the upper surface 36 and lower surface 38 respectively. This is particularly beneficial when the shelving system 10 is used in refrigerators to store perishable items. The recesses 42 allow cool air to reach the bottom surface of the perishable items stored on the shelf members 30 which may otherwise be insulated by shelf member 30 from proper refrigeration.

Figure 3:
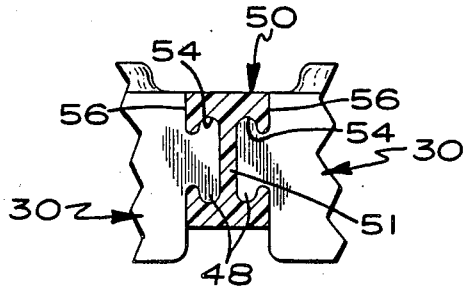
FIG. 3 is a front plan view of two adjacent shelf members held in fixed relationship by a first preferred embodiment of a connecting mechanism simultaneously engaging support rails of the adjacent shelf members.

The shelving system 10 of the present invention further discloses a novel means for detachably joining shelf members 30 supported by support post 12 at the same level or height, to extend the length of the shelving system 10. Projecting outward from and extending along at least one, and preferably all, of the outer edges of shelf members 30, are support rails 48. A connecting mechanism, such as a first preferred embodiment of an elongated extruded railing 50 of FIG. 3, simultaneously engages the support rails 48 of adjacent shelf members 30 to retain the shelf members 30 in fixed relation to each other. Extruded railing 50 includes a central block 51 having longitudinal grooves 54 along opposing longitudinal edges 56 of railing 50. Grooves 54 are configured to mate in lateral cross section with support rails 48. In a preferred embodiment, the lateral cross-section of support rails 48 and grooves 54 is generally mushroom shaped, as shown in FIG. 3. Although not shown, extruded railing 50 may also be used to join two longitudinal support rails together to form a multiple width shelf.

To attach extruded railing 50 to shelf members 30, the longitudinal axis of support rails 48 must be aligned with the longitudinal axis of the outer edge grooves 54. Support rails 48 must then be slid along and into mating engagement with grooves 54. This arrangement prevents support rails 48 from being laterally separated from extruded railings 50. To separate the shelf members 30 from extruded railing 38, the procedure outlined above is simply reversed; that is, shelf member 30 and extruded railing 50 are drawn axially apart.

Figure 7:
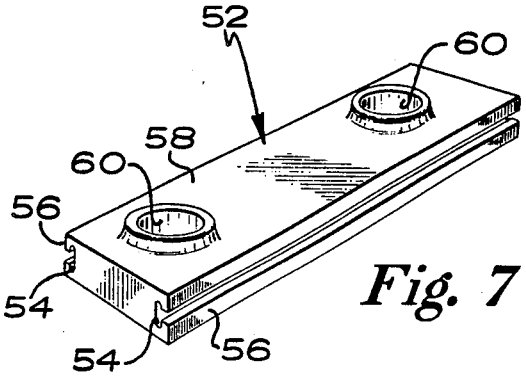
FIG. 7 is an enlarged perspective view of a second embodiment of a connecting mechanism.

A second preferred embodiment of a connecting mechanism is extruded railing 58, shown in FIG. 7. Extruded railing 58, an enhanced version of extruded railing 50, includes a central block 52 having at least one, and preferably a plurality of apertures 60 for receiving support posts 12 therethrough. Extruded railing 58 is also arranged to be detachably nested with the support post clips attached to the support posts 12 extending through apertures 60. If desired, this arrangement may be similar to the arrangement of recesses 32 of shelf members 30. By using extruded railing 58, the full length of the shelf members 30 may be utilized without interference from the support post 12, which would otherwise extend through apertures 34 of shelf members 30 if extruded railing 50 was used. As with extruded railing 50, extruded railing 58 also eliminates the need for two sets of support posts 12 at the junction of two shelf members 30, as indicated in FIG. 1, thereby reducing the cost of shelving system 10.

It is also preferred that the shelving system 10 include means for leveling the shelf members. This may be accomplished in any suitable manner, such as an adjustable screw leg 62 threaded into the base end 64 of each support post 12, as shown in FIG. 1. By appropriately extending all of the screw legs 62, shelf members 30 may be leveled even though supported on an uneven or slanted support surface.

It will also be apparent to those skilled in the art that a number of modifications and changes can be made without departing from the spirit and scope of the present invention. Therefore, it is to be understood that the invention is not to be limited except by the claims which follow.

I claim:

1. In a shelf system of the type having a plurality of elongated support posts, the support posts including grooves around their periphery at spaced intervals along the post longitudinal axes, having shelf means and having means for supporting said shelf means on said support posts, said means for supporting cooperating with said support post grooves, the improvement wherein said shelf means comprise generally rectangular shelf members having shelf connecting means mutually engaging each other, and aperture means for receiving said post means and, said aperture means having an enlarged recess means for receiving said means for supporting and said means for supporting means comprising unitary clip means having a first portion substantially surrounding a support post within a support post groove and a second portion configured to nest within said recess means.

2. The shelf system of claim 1 wherein said clip means have tapered edges extending between upper and lower surfaces thereof, said recess means including mating surfaces engaging said clip means tapered edges when said clip means are nesting within said recess means.

3. The shelving system of claim 2 wherein the shelf member defines a ribbed upper and lower surface, the upper surface having transverse ribs projecting upwardly and the lower surface having longitudinal support ribs projecting downwardly, and the upper and lower surface ribs having recesses between them.

4. The shelving system of claim 3 wherein the upper surface and lower surface recesses join at their intersection.

5. The shelving system of claim 2 wherein said shelf member defines upper and lower surfaces having alternating ribs and recesses, the recesses of one surface being orthogonal to the recesses of the other surface and joining with the recesses of the other surface at their intersection.

6. The shelving system of claim 5 wherein the shelf member is a molded plastic having hollow upper and lower surface ribs.

7. The shelving system of claim 1 wherein:

the support post has a base end; and further comprising: leveling means axially extendable from the support post base end for adjustably spacing the base end from a support surface.

8. The shelf system of claim 7 further comprising support rail means extending outwardly from opposing edges of said shelf members, said shelf connecting means supporting said shelf members by engagement with said support rail means.

9. The shelf system of claim 8 wherein said clip means have tapered edges extending between upper and lower surfaces thereof, said recess means including mating surfaces engaging said clip means tapered edges when said clip means are nesting within said recess means.

10. The shelf system of claim 7 further comprising:

support rail means extending outwardly from at least one edge of said shelf members; and shelf connector means for engaging the support rail means of different shelf members.

11. The shelf system of claim 10 wherein said clip means have tapered edges extending between upper and lower surfaces thereof, said recess means including mating surfaces engaging said clip means tapered edges when said clip means are nesting within said recess means.

12. The shelf system of claim 1 wherein said clip means have a generally rectangular body including a central opening defining said first portion, at least a portion of said clip means body being resilient.

13. The shelf system of claim 12 wherein said clip means have tapered edges extending between upper and lower surfaces thereof, said recess means including mating surfaces engaging said clip means tapered edges when said clip means are nesting within said recess means.

14. The shelf system of claim 12 wherein said clip means body means comprises resilient hinge means.

* * * * *